US011380256B2

(12) United States Patent
Chen

(10) Patent No.: US 11,380,256 B2
(45) Date of Patent: Jul. 5, 2022

(54) PIXEL DRIVING CIRCUIT AND METHOD, AND DISPLAY DEVICE

(71) Applicants: Chengdu BOE Optoelectronics Technology Co., Ltd., Chengdu (CN); BOE TECHNOLOGY GROUP CO., LTD., Beijing (CN)

(72) Inventor: Xiaohai Chen, Beijing (CN)

(73) Assignees: Chengdu BOE Optoelectronics Technology Co., Ltd., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 545 days.

(21) Appl. No.: 16/476,673

(22) PCT Filed: Jan. 30, 2019

(86) PCT No.: PCT/CN2019/074025
§ 371 (c)(1),
(2) Date: Jul. 9, 2019

(87) PCT Pub. No.: WO2020/001027
PCT Pub. Date: Jan. 2, 2020

(65) Prior Publication Data

US 2021/0407401 A1 Dec. 30, 2021

(30) Foreign Application Priority Data

Jun. 26, 2018 (CN) ..... 201810705976.7

(51) Int. Cl.
*G09G 3/3233* (2016.01)

(52) U.S. Cl.
CPC ... *G09G 3/3233* (2013.01); *G09G 2300/0809* (2013.01); *G09G 2300/0819* (2013.01); *G09G 2300/0842* (2013.01); *G09G 2300/0861* (2013.01); *G09G 2320/0233* (2013.01); *G09G 2320/045* (2013.01); *G09G 2330/02* (2013.01)

(58) Field of Classification Search
CPC ... G09G 3/32–3291; G09G 2300/0842; G09G 2300/0861; G09G 2300/0819
See application file for complete search history.

(56) References Cited

U.S. PATENT DOCUMENTS 4,833,722 A 5/1989 Morton et al.
5,929,900 A 7/1999 Yamanaka et al.
(Continued)

FOREIGN PATENT DOCUMENTS

CN 104157240 A 11/2014
CN 104485072 A 4/2015
(Continued)

OTHER PUBLICATIONS

International Search Report and Written Opinion dated Mar. 27, 2019 for PCT Patent Application No. PCT/CN2019/074025.
(Continued)

*Primary Examiner* — Patrick F Marinelli
(74) *Attorney, Agent, or Firm* — Thomas | Horstemeyer LLP

(57) ABSTRACT

A pixel driving circuit may include a first switch circuit, a second switch circuit, a first initialization circuit, a drive circuit, a second initialization circuit, a compensation circuit, an isolation circuit, and an energy storage circuit.

19 Claims, 3 Drawing Sheets

(56) References Cited

U.S. PATENT DOCUMENTS

| | | | | |
|---|---|---|---|---|
| 8,274,499 | B2 * | 9/2012 | Takahashi | G09G 3/3233 345/204 |
| 9,013,374 | B2 * | 4/2015 | Han | G09G 3/32 345/204 |
| 9,153,170 | B2 | 10/2015 | Yoo | |
| 9,286,834 | B2 * | 3/2016 | Yoon | G09G 3/3233 |
| 9,396,681 | B2 * | 7/2016 | In | G09G 3/3266 |
| 9,721,508 | B2 | 8/2017 | Sun et al. | |
| 9,728,131 | B2 | 8/2017 | Han et al. | |
| 9,823,729 | B2 * | 11/2017 | An | G09G 3/3233 |
| 9,852,688 | B2 * | 12/2017 | Lee | G09G 3/3233 |
| 9,934,728 | B2 | 4/2018 | Han et al. | |
| 10,083,658 | B2 * | 9/2018 | Wang | G09G 3/3258 |
| 10,140,920 | B2 | 11/2018 | Gai et al. | |
| 10,140,928 | B2 * | 11/2018 | Wang | G09G 3/3283 |
| 10,217,409 | B2 * | 2/2019 | Hu | G09G 3/3266 |
| 10,453,389 | B2 * | 10/2019 | Dai | G09G 3/3233 |
| 10,665,169 | B2 * | 5/2020 | Chang | G09G 3/3233 |
| 10,706,782 | B2 * | 7/2020 | Lu | G09G 3/3233 |
| 10,733,940 | B2 * | 8/2020 | Lee | G09G 3/3291 |
| 10,872,562 | B2 * | 12/2020 | Na | G09G 3/3233 |
| 10,923,032 | B2 * | 2/2021 | Qing | G09G 3/3275 |
| 11,024,228 | B2 * | 6/2021 | Wang | G09G 3/3233 |
| 11,056,061 | B2 * | 7/2021 | Fan | G09G 3/3266 |
| 2011/0090202 | A1 * | 4/2011 | Han | G09G 3/32 345/76 |
| 2011/0193856 | A1 * | 8/2011 | Han | G09G 3/3233 345/76 |
| 2011/0205220 | A1 * | 8/2011 | Ota | G09G 3/3233 345/212 |
| 2013/0120228 | A1 * | 5/2013 | Yoon | G09G 3/3233 345/80 |
| 2013/0127815 | A1 | 5/2013 | Yoo | |
| 2014/0333515 | A1 * | 11/2014 | In | G09G 3/3233 345/82 |
| 2015/0009199 | A1 * | 1/2015 | In | G09G 3/3266 345/82 |
| 2016/0124491 | A1 * | 5/2016 | An | G06F 1/3265 713/323 |
| 2016/0125802 | A1 * | 5/2016 | Lee | G09G 3/3233 345/212 |
| 2016/0372049 | A1 * | 12/2016 | Wang | G09G 3/3283 |
| 2017/0039940 | A1 | 2/2017 | Han et al. | |
| 2017/0039945 | A1 | 2/2017 | Wang et al. | |
| 2017/0069264 | A1 * | 3/2017 | Dai | G09G 3/3233 |
| 2017/0110054 | A1 | 4/2017 | Sun et al. | |
| 2017/0206838 | A1 | 7/2017 | Gai et al. | |
| 2017/0270860 | A1 * | 9/2017 | Wang | G09G 3/3258 |
| 2017/0294162 | A1 * | 10/2017 | Hu | G09G 3/3241 |
| 2017/0294164 | A1 | 10/2017 | Han et al. | |
| 2019/0096336 | A1 * | 3/2019 | Lee | G09G 3/3266 |
| 2019/0130832 | A1 * | 5/2019 | Chang | G09G 3/3233 |
| 2019/0259331 | A1 * | 8/2019 | Na | G09G 3/3233 |
| 2020/0035164 | A1 * | 1/2020 | Qing | G09G 3/3266 |
| 2020/0135105 | A1 * | 4/2020 | Lu | H01L 27/1214 |
| 2020/0234633 | A1 * | 7/2020 | Wang | G09G 3/325 |
| 2020/0234649 | A1 * | 7/2020 | Fan | G09G 3/3266 |
| 2020/0302859 | A1 * | 9/2020 | Wang | G09G 3/325 |
| 2020/0312223 | A1 * | 10/2020 | Yuan | G09G 3/3233 |
| 2021/0049965 | A1 * | 2/2021 | Jeon | G09G 3/3258 |
| 2021/0193055 | A1 * | 6/2021 | Lee | G09G 3/3233 |
| 2021/0217363 | A1 * | 7/2021 | Gao | G09G 3/3258 |
| 2021/0233469 | A1 * | 7/2021 | Chen | G09G 3/3233 |
| 2021/0256908 | A1 * | 8/2021 | Park | G09G 3/3233 |

FOREIGN PATENT DOCUMENTS

| | | | |
|---|---|---|---|
| CN | 104658482 | A | 5/2015 |
| CN | 104751798 | A | 7/2015 |
| CN | 105405397 | A | 3/2016 |
| CN | 104485072 | B | 3/2017 |
| CN | 106875893 | A | 6/2017 |
| CN | 108806596 | A | 11/2018 |

OTHER PUBLICATIONS

1st Office Action dated May 14, 2019 for Chinese Patent Application No. 201810705976.7.

2nd Office Action dated Dec. 12, 2019 for Chinese Patent Application No. 201810705976.7.

* cited by examiner

PIXEL DRIVING CIRCUIT AND METHOD, AND DISPLAY DEVICE

CROSS REFERENCE

The present application is based on International Application No. PCT/CN2019/074025, filed on Jan. 30, 2019, which is based upon, and claims the benefit of and priority to Chinese Patent Application No. 201810705976.7, filed on Jun. 26, 2018, the entire contents of which are incorporated herein by reference.

TECHNICAL FIELD

The present disclosure relates to the field of display technologies and, more particularly, to a pixel driving circuit, a pixel driving method, and a display device.

BACKGROUND

As a current-mode light-emitting device, an organic light emitting diode (OLED) display is widely used in high-performance display fields because it is self-luminous, fast in response, wide in viewing angle, able to be manufactured on a flexible substrate, etc.

However, in the process of fabricating drive transistors, threshold voltages of the drive transistors may be different at different locations due to process variation. Furthermore, as the working time extends and the operating environment changes, the threshold voltages of the drive transistors may drift, which may lead to nonuniform light emission of an OLED display, thus causing a poor viewing experience.

It is to be noted that the above information disclosed in this Background section is only for enhancement of understanding of the background of the present disclosure and therefore, it may contain information that does not form the related art that is already known to a person of ordinary skill in the art.

SUMMARY

An objective of the present disclosure is to provide a pixel driving circuit, a pixel driving method, and a display device.

According to an aspect of the present disclosure, a pixel driving circuit for driving an electroluminescent element is provided. The pixel driving circuit includes: a first switch circuit, coupled to a first node and configured to be enabled in response to a scan signal to transmit a data signal to the first node; a second switch circuit, coupled to the first node and configured to be enabled in response to a control signal to transmit a reference signal to the first node; a first initialization circuit, coupled to the first node and configured to be enabled in response to a reset signal to transmit an initialization signal to the first node; a drive circuit, coupled to a second node and a third node and configured to be enabled in response to a signal from the second node, and output a drive current to the third node under an action of a first power signal; a second initialization circuit, coupled to the second node and configured to be enabled in response to the reset signal to transmit the initialization signal to the second node; a compensation circuit, coupled to the second node and the third node and configured to be enabled in response to the scan signal to communicate the second node with the third node; an isolation circuit, coupled to the third node and configured to be enabled in response to the control signal to transmit the drive current to the electroluminescent element; and an energy storage circuit, coupled between the first node and the second node.

In an exemplary embodiment of the present disclosure, the first switch circuit includes a first transistor, wherein a first terminal of the first transistor is configured to receive the data signal, a second terminal of the first transistor is coupled to the first node, and a control terminal of the first transistor is configured to receive the scan signal.

In an exemplary embodiment of the present disclosure, the second switch circuit includes a second transistor, wherein a first terminal of the second transistor is configured to receive the reference signal, a second terminal of the second transistor is coupled to the first node, and a control terminal of the second transistor is configured to receive the control signal.

In an exemplary embodiment of the present disclosure, the first initialization circuit includes a third transistor, wherein a first terminal of the third transistor is configured to receive the initialization signal, a second terminal of the third transistor is coupled to the first node, and a control terminal of the third transistor is configured to receive the reset signal.

In an exemplary embodiment of the present disclosure, the second initialization circuit includes a fourth transistor, wherein a first terminal of the fourth transistor is configured to receive the initialization signal, a second terminal of the fourth transistor is coupled to the second node, and a control terminal of the fourth transistor is configured to receive the reset signal.

In an exemplary embodiment of the present disclosure, the drive circuit includes a drive transistor, wherein a first terminal of the drive transistor is configured to receive the first power signal, a second terminal of the drive transistor is coupled to the third node, and a control terminal of the drive transistor is coupled to the second node.

In an exemplary embodiment of the present disclosure, the compensation circuit includes a fifth transistor, wherein a first terminal of the fifth transistor is coupled to the second node, a second terminal of the fifth transistor is coupled to the third node, and a control terminal of the fifth transistor is configured to receive the scan signal.

In an exemplary embodiment of the present disclosure, the isolation circuit includes a sixth transistor, wherein a first terminal of the sixth transistor is coupled to the third node, a second terminal of the sixth transistor is coupled to the electroluminescent element, and a control terminal of the sixth transistor is configured to receive the control signal.

According to an aspect of the present disclosure, a pixel driving circuit for driving an electroluminescent element is provided. The pixel driving circuit includes: a first transistor, a first terminal of the first transistor being configured to receive a data signal, a second terminal of the first transistor being coupled to a first node, and a control terminal of the first transistor being configured to receive a scan signal; a second transistor, a first terminal of the second transistor being configured to receive a reference signal, a second terminal of the second transistor being coupled to the first node, and a control terminal of the second transistor being configured to receive a control signal; a third transistor, a first terminal of the third transistor being configured to receive an initialization signal, a second terminal of the third transistor being coupled to the first node, and a control terminal of the third transistor being configured to receive a reset signal; a drive transistor, a first terminal of the drive transistor being configured to receive a first power signal, a second terminal of the drive transistor being coupled to a third node, and a control terminal of the drive transistor being coupled to a second node; a fourth transistor, a first terminal of the fourth transistor being configured to receive the initialization signal, a second terminal of the fourth transistor being coupled to the second node, and a control terminal of the fourth transistor being configured to receive the reset signal; a fifth transistor, a first terminal of the fifth transistor being coupled to the second node, a second terminal of the fifth transistor being coupled to the third node, and a control terminal of the fifth transistor being configured to receive the scan signal; a sixth transistor, a first terminal of the sixth transistor being coupled to the third node, a second terminal of the sixth transistor being coupled to the electroluminescent element, and a control terminal of the sixth transistor being configured to receive the control signal; and a storage capacitor, a first terminal of the storage capacitor being coupled to the first node, and a second terminal of the storage capacitor being coupled to the second node.

According to an aspect of the present disclosure, a pixel driving method for driving the pixel driving circuit according to any one of the above embodiments is provided. The pixel driving method includes: in a reset phase, enabling the first initialization circuit and the second initialization circuit by using the reset signal to write the initialization signal into the first node and the second node; in a charging phase, enabling the first switch circuit and the compensation circuit by using the scan signal to write the data signal and a threshold voltage of the drive circuit into the energy storage circuit; in a light enable phase, enabling the second switch circuit and the isolation circuit by using the control signal, such that the drive circuit is enabled under an action of a signal from the second node, and a drive current is outputted to the electroluminescent element through the isolation circuit under the action of the first power signal.

In an exemplary embodiment of the present disclosure, a voltage of the initialization signal is zero.

In an exemplary embodiment of the present disclosure, a buffer period exists between an enable period of the reset signal and an enable period of the scan signal.

According to an aspect of the present disclosure, a display device, which includes the pixel driving circuit according to any one of the above embodiments, is provided.

It is to be noted that the above information disclosed in this Background section is only for enhancement of understanding of the background of the present disclosure and therefore it may contain information that does not form the related art that is already known to a person of ordinary skill in the art.

BRIEF DESCRIPTION OF THE DRAWINGS

The above and other features and advantages of the present disclosure will become more apparent by describing in detail the exemplary embodiments thereof with reference to the accompanying drawings. Understandably, the accompanying drawings in the following description show merely some embodiments of the present disclosure, and persons of ordinary skill in the art may still derive other drawings from these accompanying drawings without creative efforts. In the drawings.

DETAILED DESCRIPTION

Figure 1:
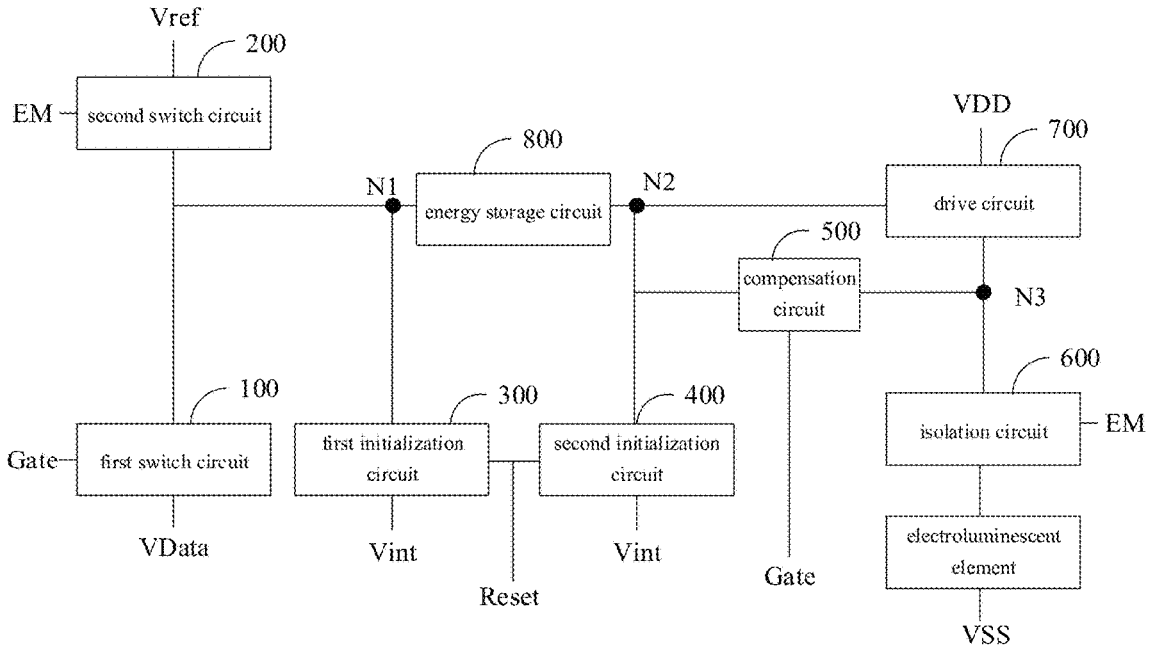
FIG. 1 is a schematic diagram of a pixel driving circuit according to the present disclosure.

The exemplary embodiment will now be described more fully with reference to the accompanying drawings. However, the exemplary embodiments can be implemented in a variety of forms and should not be construed as limited to the embodiments set forth herein. Rather, the embodiments are provided so that this disclosure will be thorough and complete, and will fully convey the concepts of exemplary embodiments to those skilled in the art. The features, structures, or characteristics described may be combined in one or more embodiments in any suitable manner. In the following description, numerous specific details are provided to give a full understanding of the embodiments of the present disclosure. However, those skilled in the art will appreciate that one or more of the specific details may be practiced without practicing the technical solutions of the present disclosure, and other methods, components, materials, devices, steps, and the like may be employed. In other instances, well-known technical solutions are not shown or described in detail to avoid obscuring aspects of the present disclosure.

In addition, the accompanying drawings are merely exemplary illustration of the present disclosure, and are not necessarily drawn to scale. The same reference numerals in the drawings denote the same or similar parts, and thus, repeated description thereof will be omitted.

It is found that different locations where pixels of a display are located may cause different voltage drops (I-R Drops) of a power source, which may affect the drive current of an OLED. Failure of compensating for threshold voltages and the I-R Drops of the power source may lead to nonuniform light emission of an OLED display, thus, causing a poor viewing experience.

This exemplary embodiment provides a pixel driving circuit for driving an electroluminescent element. Referring to FIG. 1, the pixel driving circuit may include:

a first switch circuit 100, coupled to a first node N1 and configured to be enabled in response to a scan signal Gate to transmit a data signal VData to the first node N1;

a second switch circuit 200, coupled to the first node N1 and configured to be enabled in response to a control signal EM to transmit a reference signal Vref to the first node N1;

a first initialization circuit 300, coupled to the first node N1 and configured to be enabled in response to a reset signal Reset to transmit an initialization signal Vint to the first node N1;

a second initialization circuit 400, coupled to the second node N2 and configured to be enabled in response to the reset signal Reset to transmit the initialization signal Vint to the second node N2;

a compensation circuit 500, coupled to the second node N2 and the third node N3 and configured to be enabled in response to the scan signal Gate to communicate the second node N2 with the third node N3;

a drive circuit 700, coupled to a second node N2 and a third node N3 and configured to be enabled in response to a signal from the second node N2, and output a drive current to the third node N3 under an action of a first power signal VDD;

an isolation circuit 600, coupled to the third node N3 and configured to be enabled in response to the control signal EM to transmit the drive current to the electroluminescent element; and an energy storage circuit 800, coupled between the first node N1 and the second node N2.

By means of the above compensation circuit, in one aspect, the second node N2 is communicated with the third node N3, such that the control terminal of the drive circuit is communicated with the second terminal of the drive circuit to write the threshold voltage of a transistor in the drive circuit and the first power signal into the second node. That is, the threshold voltage of the drive circuit is compensated to eliminate the negative effect of the threshold voltage of the drive circuit on the drive current, thereby ensuring the drive current of each pixel driving circuit to be uniform and thus ensuring the uniformity of the display brightness of each pixel. In another aspect, the compensation circuit may also eliminate the negative effect of the first power signal on the voltage between the control terminal and the first terminal of the drive circuit, thereby eliminating the negative effect of the power IR drop on the display brightness of each pixel, ensuring the drive current outputted by each pixel driving circuit to be uniform and thus, ensuring the uniformity of the display brightness of each pixel.

Figure 2:
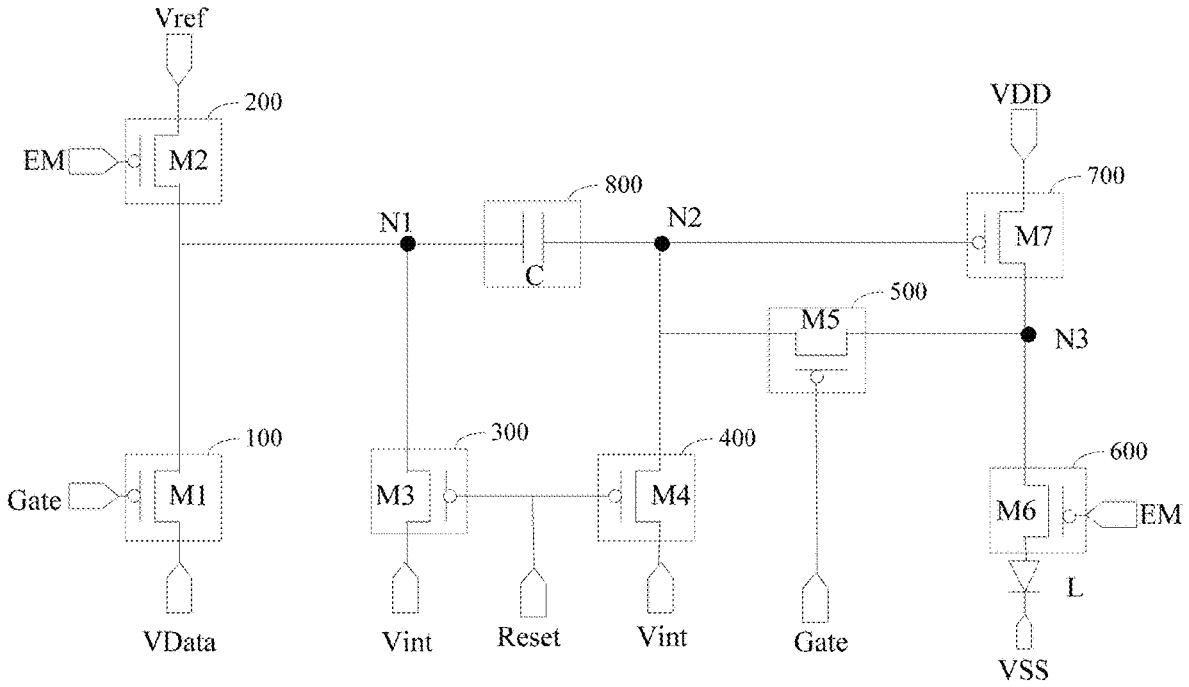
FIG. 2 is a schematic structural diagram of a pixel driving circuit according to the present disclosure.

Each circuit in the pixel driving circuit in this exemplary embodiment is described in detail below with reference to the accompanying drawings. Referring to FIG. 2, the first switch circuit includes a first transistor M1, the second switch circuit includes a second transistor M2, the first initialization circuit includes a third transistor M3, the second initialization circuit includes a fourth transistor M4, the drive circuit includes a drive transistor M7, the compensation circuit includes a fifth transistor M5, the isolation circuit includes a sixth transistor M6, and the energy storage circuit includes a storage capacitor C.

Referring to FIG. 2, the first transistor to the sixth transistor and the drive transistor have a control terminal, a first terminal, and a second terminal, respectively. On this basis, a connection relation between the first transistor to the sixth transistor (M1~M6) and the drive transistor M7 in the above pixel driving circuit is as below.

A first terminal of the first transistor M1 is configured to receive the data signal VData, a second terminal of the first transistor M1 is coupled to the first node N1, and a control terminal of the first transistor M1 is configured to receive the scan signal Gate. A first terminal of the second transistor M2 is configured to receive the reference signal Vref, a second terminal of the second transistor M2 is coupled to the first node N1, and a control terminal of the second transistor M2 is configured to receive the control signal EM. A first terminal of the third transistor M3 is configured to receive the initialization signal Vint, a second terminal of the third transistor M3 is coupled to the first node N1, and a control terminal of the third transistor M3 is configured to receive the reset signal Reset. A first terminal of the drive transistor M7 is configured to receive the first power signal VDD, a second terminal of the drive transistor M7 is coupled to the third node N3, and a control terminal of the drive transistor M7 is coupled to the second node N2. A first terminal of the fourth transistor M4 is configured to receive the initialization signal Vint, a second terminal of the fourth transistor M4 is coupled to the second node N2, and a control terminal of the fourth transistor M4 is configured to receive the reset signal Reset. A first terminal of the fifth transistor M5 is coupled to the second node N2, a second terminal of the fifth transistor M5 is coupled to the third node N3, and a control terminal of the fifth transistor M5 is configured to receive the scan signal Gate. A first terminal of the sixth transistor M6 is coupled to the third node N3, a second terminal of the sixth transistor M6 is coupled to the electroluminescent element L, and a control terminal of the sixth transistor M6 is configured to receive the control signal EM. A first terminal of the storage capacitor C is coupled to the first node N1, and a second terminal of the storage capacitor C is coupled to the second node N2.

It is to be noted that the control terminal of each transistor may be a gate, the first terminal thereof may be a source, and the second terminal thereof may be a drain, or the first terminal and the second terminal of each transistor may be interchangeable. In this exemplary embodiment, all of the transistors may be N-type thin film transistors or P-type thin film transistors. It is to be noted that for different types of transistors, a level signal of each signal terminal needs to be correspondingly adjusted or changed. The thin film transistors may be one or more of amorphous silicon thin film transistors, polysilicon thin film transistors, and amorphous-indium gallium zinc oxide thin film transistors.

For example, when the first transistor to the sixth transistor are P-type thin film transistors, the first terminal of each of the transistors may be a source, and the second terminal of each of the transistors may be a drain. For another example, when the first transistor to the sixth transistor are N-type thin film transistors, the first terminal of each of the transistors may be a drain, and the second terminal of each of the transistors may be a source. It is to be noted that the above transistors may be other types of transistors, which is not particularly limited by this exemplary embodiment.

In addition, each of the transistors may be either an enhancement-type transistor or a depletion-type transistor, which is not particularly limited by this exemplary embodiment. It is to be noted that since the source and the drain of each transistor are symmetrical, the source and the drain of the transistor is interchangeable.

The drive transistor M7 has a control terminal, a first terminal, and a second terminal. For example, the control terminal of the drive transistor M7 may be a gate, the first terminal of the drive transistor M7 may be a source, and the second terminal of the drive transistor M7 may be a drain. In another example, the control terminal of the drive transistor M7 may be a gate, the first terminal of the drive transistor M7 may be a drain, and the second terminal of the drive transistor M7 may be a source. In addition, the drive transistor M7 may be either an enhancement-type drive transistor or a depletion-type drive transistor, which is not particularly limited by this exemplary embodiment.

The type of the storage capacitor C may be selected according to a specific circuit. For example, the storage capacitor C may be an MOS capacitor, a metal capacitor, or a double-crystal or poly-silicon capacitor, and the like, which is not particularly limited in this exemplary embodiment.

The electroluminescent element L is a current-driven electroluminescent element, which is controlled by a current flowing through the drive transistor M7 to emit light. For example, the electroluminescent element may be an OLED, but the electroluminescent element L in this exemplary embodiment is not limited thereto. Furthermore, the electroluminescent element L has a first electrode and a second electrode. For example, the first electrode of the electroluminescent element L may be an anode, and the second electrode of the electroluminescent element L may be a cathode. In addition, the first electrode and the second electrode of the electroluminescent element L are also interchangeable. The first electrode of the electroluminescent element L is coupled to the first terminal of the sixth transistor, and the second electrode of the electroluminescent element L is coupled to the second power signal VS S.

In a plurality of pixel driving circuits arranged in an array, in order to simplify the circuit structure of the plurality of pixel driving circuits arranged in the array, progressive scanning may be implemented by reusing the scan signal Gate in each pixel driving circuit. The pixel driving circuit is coupled to the (N−1)th row of scan signal lines and the Nth row of scan signal lines, wherein the Nth row of scan signal lines are configured to output the scan signal Gate, and the (N−1)th row of scan signal lines are configured to output the reset signal Reset, and wherein the N is a positive integer.

Figure 3:
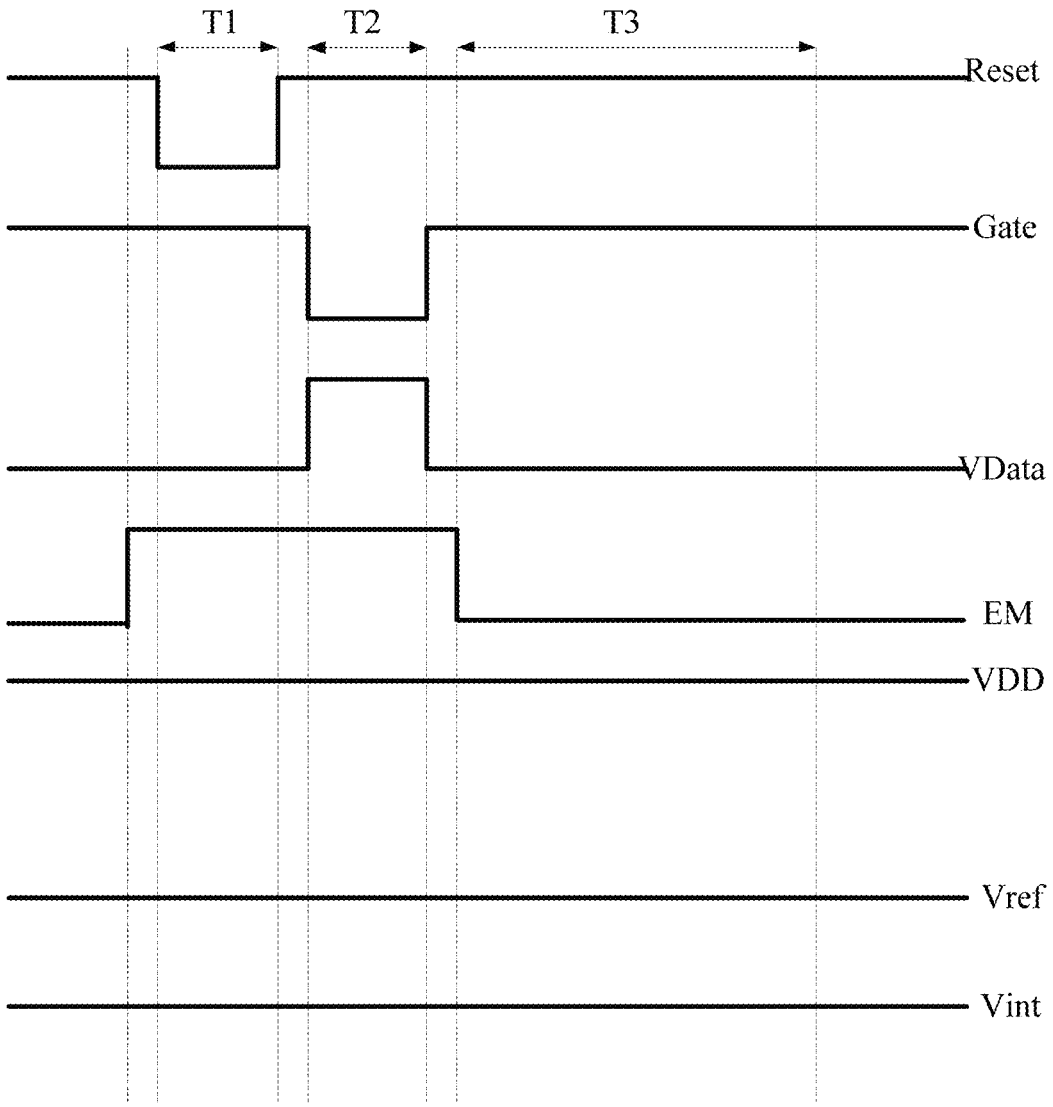
FIG. 3 is an operating timing diagram of a pixel driving circuit according to an exemplary embodiment of the present disclosure.

In an exemplary embodiment of the present disclosure, a pixel driving method for driving the pixel driving circuit as shown in FIG. 1 and FIG. 2 is provided. Hereinafter, taking an example in which all the transistors are P-type thin film transistors and the drive transistor is also a P-type drive transistor, the working process of the pixel driving circuit in FIG. 1 and FIG. 2 is described in detail in conjunction with the operation timing chart of the pixel driving circuit as shown in FIG. 3. Because all the transistors are P-type thin film transistors, the first terminal of each of the transistors is a source, the second terminal of each of the transistors is a drain, an enable signal of each transistor is a low level signal, and a disable signal of the transistor is a high level signal. The drive timing chart illustrates the control signal EM, the scan signal Gate, the initialization signal Vint, the data signal VData, the reference signal Vref, the reset signal Reset, and the first power signal VDD, wherein the first power signal VDD maintains a high level signal, the reference signal Vref remains smaller than the data signal VData, and the voltage of the initialization signal Vint may be, for example, zero. It is to be noted that maintaining the initialization signal Vint at a low-level signal can reduce or eliminate the negative effect of the initialization signal on the drive current.

On this basis, the working process of the pixel driving circuit may specifically include the following phases.

In a T1 phase (i.e., a reset phase), the first initialization circuit and the second initialization circuit are enabled by using the reset signal Reset to write the initialization signal into the first node and the second node. Specifically, in the T1 phase, under the action of the high level signal of the control signal EM, both the second transistor M2 and the sixth transistor M6 are turned off. Under the action of the high level signal of the scan signal Gate, both the first transistor M1 and the fifth transistor M5 are turned off. Under the action of the low level signal of the reset signal Reset, both the third transistor M3 and the fourth transistor M4 are enabled. In this way, the initialization signal Vint may be transmitted to the first node N1 through the third transistor M3, and the initialization signal Vint may be transmitted to the second node N2 through the fourth transistor M4. Since the initialization signal Vint in the T1 phase is a low level signal, both the first node and the second node are low level signals. Further, the drive transistor M7 is enabled under the action of the low level signal of the second node N2 to transmit the first power signal VDD to the third node N3 through the drive transistor M7.

In a T2 phase (i.e., a charging phase), the first switch circuit 100 and the compensation circuit 500 may be enabled by using the scan signal Gate to write the data signal and a threshold voltage of the drive circuit 700 into the energy storage circuit 800. Specifically, in the T2 phase, under the action of the low level signal of the scan signal Gate, both the first transistor M1 and the fifth transistor M5 are enabled. Under the action of the high level signal of the reset signal Reset, both the third transistor M3 and the fourth transistor M4 are turned off. Under the action of the high level signal of the control signal EM, both the second transistor M2 and the sixth transistor M6 are turned off. In this way, the data signal VData may be transmitted to the first node N1 through the first transistor M1, and the voltage of the first node N1 is VData at this moment. Since the fifth transistor M5 is enabled, the control terminal of the drive transistor M7 may be communicated with the second terminal of the drive transistor M7, such that the first power signal VDD and the threshold voltage Vth of the drive transistor M7 are written into the second node N2. Therefore, the voltage of the second node N2 is VDD+Vth, the storage capacitor is charged via the first node and the second node, and the data signal VData and the threshold voltage Vth of the drive circuit are written into the energy storage circuit. Meanwhile, the drive transistor M7 is enabled, and thus the first power signal VDD and the threshold voltage Vth of the drive transistor M7 are written into the third node N3. In this phase, the storage capacitor C may be directly charged via the first power signal VDD, which can greatly enhance the capacitance charging speed. Between the T2 phase and the T3 phase, due to a sudden change in signal, the scan signal Gate may boost the voltage of the first node N1 and the voltage of the second node N2 by parasitic capacitive coupling.

It is to be noted that as shown in FIG. 3, between the T1 phase and the T2 phase, a buffer period exists between an enable period of the reset signal Reset and an enable period of the scan signal Gate. By setting the buffer period, cross-talk between the reset signal and the scan signal may be reduced.

In a T3 phase (i.e., a light enable phase), the second switch circuit 200 and the isolation circuit 600 may be enabled by using the control signal EM, such that the drive circuit 700 is enabled under an action of a signal from the second node N2, and a drive current is outputted to the electroluminescent element L through the isolation circuit 600 under the action of the first power signal VDD. Specifically, in the T3 phase, under the action of the high level signal of the scan signal Gate, both the first transistor M1 and the fifth transistor M5 are turned off. Under the action of the high level signal of the reset signal Reset, both the third transistor M3 and the fourth transistor M4 are turned off. Under the action of the low level signal of the control signal EM, both the second transistor M2 and the sixth transistor M6 are enabled. In this way, the reference signal Vref may be transmitted to the first node N1 through the second transistor M2. At this moment, the voltage of the first node N1 is Vref, and the voltage variation of the first node with respect to the previous phase is Vref-VData. Meanwhile, due to the bootstrap action of the energy storage capacitor C, the equal voltage variation occurs in the second node N2 on the basis of the T2 phase. That is, the voltage of the second node N2 is changed from VDD+Vth in the T2 phase to VDD+Vth+Vref-VData in the T3 phase. As can be seen from the simulation result in FIG. 4, the voltage variation Vref-VData of the first node N1 in the T3 phase with respect to the T2 phase is a negative value.

In the voltage VDD+Vth+Vref-VData of the second node N2, Vref-VData is a negative value. Therefore, the differential between VDD+Vth+Vref-VData and the first power signal VDD is smaller than the threshold voltage Vth of the drive transistor M7. In this case, the drive transistor M7 can be enabled under the action of a voltage signal of the second node N2, a drive current is outputted under the action of the first power signal VDD, and the drive current is transmitted to the electroluminescent element L through the sixth transistor M6 to drive the electroluminescent element L to emit light. Reference is made with reference to the simulation diagram, when the threshold voltage is about −2.3V and the first power signal VDD is 5V, the voltage VDD+Vth+Vref-VData of the second node N2 is 1.7V, and the differential between VDD+Vth+Vref-VData and the first power signal VDD is smaller than the threshold voltage Vth of the drive transistor M7. It is to be noted that the reference signal Vref may be set smaller than the data signal VData, such that the drive transistor M7 is enabled. For example, the reference signal Vref may be set to −1V or 0V or 1V, etc., and the data signal VData may be set between 2V and 5V. The drive transistor M7 may be enabled as long as the reference signal Vref is smaller than the minimum value of the data signal VData.

In the voltage VDD+Vth+Vref-VData of the second node N2, the threshold voltage Vth herein is represented by a negative value. If the differential between VDD+Vth+Vref-VData and the first power signal VDD is smaller than the threshold voltage Vth of the drive transistor M7, the drive transistor M7 can be enabled under the action of a voltage signal of the second node N2, a drive current is outputted under the action of the first power signal VDD, and the drive current is transmitted to the electroluminescent element L through the sixth transistor M6 to drive the electroluminescent element L to emit light. In this case, supposing the voltage of the first electrode of the electroluminescent element L is changed to the enable voltage VL of the electroluminescent element L, the voltage of the first node N1 is the reference voltage Vref, and the voltage of the second node N2 is changed to VX.

On this basis, the formula for calculating the drive current of the drive transistor M7 may be expressed as:

$$\mathrm{Ion}=K\times(Vgs-Vth)2=K\times(VX-VDD-Vth)2.$$

In the following, according to the principle of conservation of electric charge, i.e., the electric charges in the pixel driving circuit in the T2 phase is equal to those in the pixel driving circuit in the T3 phase, it may be obtained:

$$(VDD+Vth-V\mathrm{Data})C=(VX-V\mathrm{ref})C$$

By solving the above formula, it may be obtained: VX=VDD+Vth−VData+Vref.

By substituting VX into the formula for calculating the drive current of the drive transistor M7, the following equation may be obtained:

$$\mathrm{Ion}=K\times(VDD+Vth-V\mathrm{Data}+V\mathrm{ref}-VDD-Vth)2=K\times(V\mathrm{ref}-V\mathrm{Data})2$$

As can be seen from the above equation, the drive current is related to neither the threshold voltage Vth of the drive transistor M7 nor the voltage of the first power signal VDD.

Figure 4:
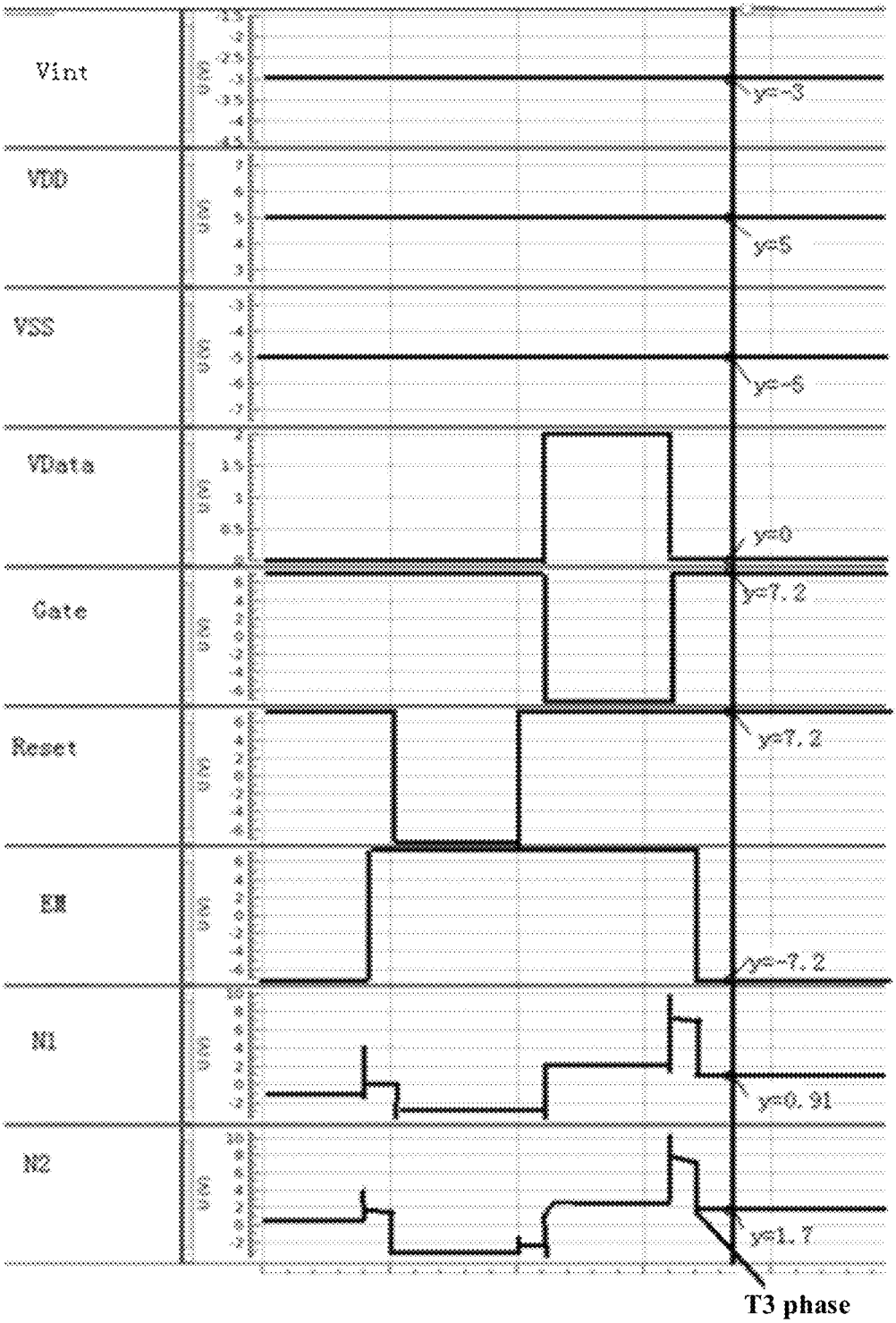
FIG. 4 is a schematic diagram of a simulation result of a pixel driving circuit according to the present disclosure.

In association with voltage simulation results of the first node and the second node in FIG. 4, by enabling the fifth transistor in the T2 phase, the control terminal of the drive transistor M7 is communicated with the second terminal of the drive transistor M7 to write the threshold voltage Vth of the drive transistor M7 and the first power signal VDD into the second node N2. That is, the threshold voltage Vth of the drive transistor M7 is compensated to eliminate the negative effect of the threshold voltage Vth of the drive transistor M7 on the drive current, thereby ensuring the drive current of each pixel driving circuit to be uniform and thus ensuring the uniformity of the display brightness of each pixel. Furthermore, the negative effect of the first power signal VDD on the voltage between the control terminal and the first terminal of the drive transistor M7 is eliminated, thereby eliminating the negative effect of the power IR drop on the display brightness of each pixel, ensuring the drive current outputted by each pixel driving circuit in the light enable phase to be uniform, and thus, ensuring the uniformity of the display brightness of each pixel. In addition, the pixel driving circuit in this example may also reduce jitter of the first power signal VDD, and may also achieve the objective of reducing power consumption via a lower reference voltage.

In this exemplary embodiment, the use of a full P-type thin film transistor has the following advantages: strong in noise suppression, easy to implement charge management at a low level, simple in fabricating the P-type thin film transistor, lower in price, and better in stability of the P-type thin film transistors.

It is to be noted that in the foregoing specific embodiments, all the transistors are P-type thin film transistors. However, those skilled in the art may easily learn that all transistors are pixel driving circuits of N-type thin film transistors according to the pixel driving circuit provided by the present disclosure. In an exemplary embodiment of the present disclosure, all of the transistors may be N-type thin film transistors. Since the transistors are N-type thin film transistors, ON signals of the transistors are high level signals, the first terminals of the transistors are drains, and the second terminals of the transistors are sources. Of course, the pixel driving circuit provided by the present disclosure may be changed into a complementary metal oxide semiconductor (CMOS) circuit or the like, and is not limited to the pixel driving circuit provided in this embodiment, and details thereof are omitted herein.

This exemplary embodiment further provides a display device, which includes the above pixel driving circuit.

The display device may also include: a plurality of scan lines for providing scan signals; a plurality of data lines for providing data signals; and a plurality of pixel driving circuits electrically connected to the scan lines and the data lines. The display device may include, for example, any product or component having a display function, such as a mobile phone, a tablet computer, a TV set, a notebook computer, a digital photo frame, a navigation device, and so on. Through the fifth transistor in the above pixel driving circuit, the control terminal of the drive transistor is communicated with the second terminal of the drive transistor to write the threshold voltage of the drive transistor and the first power signal into the second node. That is, the threshold voltage of the drive transistor is compensated to eliminate the negative effect of the threshold voltage of the drive transistor on the drive current, thereby ensuring the drive current outputted by each pixel driving circuit to be uniform and thus, ensuring the uniformity of the display brightness of each pixel. Furthermore, the negative effect of the first power signal on the voltage between the control terminal and the first terminal of the drive transistor is eliminated, thereby eliminating the negative effect of the power IR drop on the display brightness of each pixel, ensuring the drive current outputted by each pixel driving circuit to be uniform, and thus, ensuring the uniformity of the display brightness of each pixel.

It is to be noted that specific details of modules and circuits in the display device have been described in detail in the corresponding pixel driving circuit, and thus their detailed descriptions are omitted herein.

It is to be noticed that although a plurality of modules or circuits of the device for action execution have been mentioned in the above detailed description, this partition is not compulsory. Actually, according to the embodiments of the present disclosure, features, and functions of two or more modules or circuits as described above may be embodied in one module or circuit. Reversely, features and functions of one module or circuit as described above may be further embodied in a plurality of modules or circuit.

In addition, steps of the method in the present disclosure are described in a particular order in the accompanying drawings. However, this does not require or imply to execute these steps necessarily according to the particular order, or this does not mean that the expected result cannot be implemented unless all the shown steps are executed. Additionally or alternatively, some steps may be omitted, a plurality of steps may be combined into one step for execution, and/or one step may be decomposed into a plurality of steps for execution.

Other implementation solutions of the present disclosure will be apparent to those skilled in the art from consideration of the specification and practice of the implementation manners disclosed here. This application is intended to cover any variations, uses, or adaptations of the present disclosure following the general principles thereof and including such departures from the present disclosure as come within known or customary practice in the art. It is intended that the specification and embodiments be considered as exemplary only, with a true scope and spirit of the present disclosure being indicated by the appended claims.

What is claimed is:

1. A system, comprising:

a pixel driving circuit for driving an electroluminescent element, comprising:

a first switch circuit, coupled to a first node and configured to be enabled in response to a scan signal to transmit a data signal to the first node;

a second switch circuit, coupled to the first node and configured to be enabled in response to a control signal to transmit a reference signal to the first node;

a first initialization circuit, coupled to the first node and configured to be enabled in response to a reset signal to transmit an initialization signal to the first node;

a drive circuit, coupled to a second node and a third node and configured to be enabled in response to a signal from the second node, and output a drive current to the third node under an action of a first power signal;

a second initialization circuit, coupled to the second node and configured to be enabled in response to the reset signal to transmit the initialization signal to the second node;

a compensation circuit, coupled to the second node and the third node and configured to be enabled in response to the scan signal to communicate the second node with the third node;

an isolation circuit, coupled to the third node and configured to be enabled in response to the control signal to transmit the drive current to the electroluminescent element; and an energy storage circuit, coupled between the first node and the second node, wherein a voltage of the initialization signal is zero, and the initialization signal is separate and distinct from the first power signal.

2. The system according to claim 1, the first switch circuit comprising a first transistor, wherein a first terminal of the first transistor is configured to receive the data signal, a second terminal of the first transistor is coupled to the first node, and a control terminal of the first transistor is configured to receive the scan signal.

3. The system according to claim 1, the second switch circuit comprising a second transistor, wherein a first terminal of the second transistor is configured to receive the reference signal, a second terminal of the second transistor is coupled to the first node, and a control terminal of the second transistor is configured to receive the control signal.

4. The system according to claim 3, further comprising a display device, the display device comprising the pixel driving circuit.

5. The system according to claim 1, the first initialization circuit comprising a third transistor, wherein a first terminal of the third transistor is configured to receive the initialization signal, a second terminal of the third transistor is coupled to the first node, and a control terminal of the third transistor is configured to receive the reset signal.

6. The system according to claim 5, further comprising a display device, the display device comprising the pixel driving circuit.

7. The system according to claim 1, the second initialization circuit comprising a fourth transistor, wherein a first terminal of the fourth transistor is configured to receive the initialization signal, a second terminal of the fourth transistor is coupled to the second node, and a control terminal of the fourth transistor is configured to receive the reset signal.

8. The system according to claim 7, further comprising a display device, the display device comprising the pixel driving circuit.

9. The system according to claim 1, the drive circuit comprising a drive transistor, wherein a first terminal of the drive transistor is configured to receive the first power signal, a second terminal of the drive transistor is coupled to the third node, and a control terminal of the drive transistor is coupled to the second node.

10. The system according to claim 9, further comprising a display device, the display device comprising the pixel driving circuit.

11. The system according to claim 1, the compensation circuit comprising a fifth transistor, wherein a first terminal of the fifth transistor is coupled to the second node, a second terminal of the fifth transistor is coupled to the third node, and a control terminal of the fifth transistor is configured to receive the scan signal.

12. The system according to claim 11, the compensation circuit comprising the fifth transistor, wherein the fifth transistor communicates the second node with the third node to communicate a control terminal of the drive circuit with a second terminal of the drive circuit so as to write a threshold voltage of a transistor in the drive circuit and the first power signal into the second node.

13. The system according to claim 11, further comprising a display device, the display device comprising the pixel driving circuit.

14. The system according to claim 1, the isolation circuit comprising a sixth transistor, wherein a first terminal of the sixth transistor is coupled to the third node, a second terminal of the sixth transistor is coupled to the electroluminescent element, and a control terminal of the sixth transistor is configured to receive the control signal.

15. The system according to claim 1, further comprising a display device, the display device comprising the pixel driving circuit.

16. A pixel driving circuit for driving an electroluminescent element, comprising:

a first transistor, a first terminal of the first transistor being configured to receive a data signal, a second terminal of the first transistor being coupled to a first node, and a control terminal of the first transistor being configured to receive a scan signal;

a second transistor, a first terminal of the second transistor being configured to receive a reference signal, a second terminal of the second transistor being coupled to the first node, and a control terminal of the second transistor being configured to receive a control signal;

a third transistor, a first terminal of the third transistor being configured to receive an initialization signal, a second terminal of the third transistor being coupled to the first node, and a control terminal of the third transistor being configured to receive a reset signal;

a drive transistor, a first terminal of the drive transistor being configured to receive a first power signal, a second terminal of the drive transistor being coupled to a third node, and a control terminal of the drive transistor being coupled to a second node;

a fourth transistor, a first terminal of the fourth transistor being configured to receive the initialization signal, a second terminal of the fourth transistor being coupled to the second node, and a control terminal of the fourth transistor being configured to receive the reset signal;

a fifth transistor, a first terminal of the fifth transistor being coupled to the second node, a second terminal of the fifth transistor being coupled to the third node, and a control terminal of the fifth transistor being configured to receive the scan signal;

a sixth transistor, a first terminal of the sixth transistor being coupled to the third node, a second terminal of the sixth transistor being coupled to the electroluminescent element, and a control terminal of the sixth transistor being configured to receive the control signal; and a storage capacitor, a first terminal of the storage capacitor being coupled to the first node, and a second terminal of the storage capacitor being coupled to the second node, wherein a voltage of the initialization signal is zero, and the initialization signal is separate and distinct from the first power signal.

17. A pixel driving method for driving a pixel driving circuit, the pixel driving method comprising:

providing the pixel driving circuit, the pixel driving circuit comprising:

a first switch circuit, coupled to a first node and configured to be enabled in response to a scan signal to transmit a data signal to the first node;

a second switch circuit, coupled to the first node and configured to be enabled in response to a control signal to transmit a reference signal to the first node;

a first initialization circuit, coupled to the first node and configured to be enabled in response to a reset signal to transmit an initialization signal to the first node;

a drive circuit, coupled to a second node and a third node and configured to be enabled in response to a signal from the second node, and output a drive current to the third node under an action of a first power signal;

a second initialization circuit, coupled to the second node and configured to be enabled in response to the reset signal to transmit the initialization signal to the second node;

a compensation circuit, coupled to the second node and the third node and configured to be enabled in response to the scan signal to communicate the second node with the third node;

an isolation circuit, coupled to the third node and configured to be enabled in response to the control signal to transmit the drive current to the electroluminescent element; and an energy storage circuit, coupled between the first node and the second node;

in a reset phase, enabling the first initialization circuit and the second initialization circuit by using the reset signal to write the initialization signal into the first node and the second node;

in a charging phase, enabling the first switch circuit and the compensation circuit by using the scan signal to write the data signal and a threshold voltage of the drive circuit into the energy storage circuit; and in a light enable phase, enabling the second switch circuit and the isolation circuit by using the control signal, such that the drive circuit is enabled under an action of a signal from the second node, and a drive current is outputted to the electroluminescent element through the isolation circuit under the action of the first power signal, wherein a voltage of the initialization signal is zero, and the initialization signal is separate and distinct from the first power signal.

18. The pixel driving method according to claim 17, the enabling the first switch circuit and the compensation circuit by using the scan signal to write the data signal and a threshold voltage of the drive circuit into the energy storage circuit comprises:

transmitting the data signal to the first node by the first switch circuit;

enabling the drive circuit by enabling the compensation circuit to write the first power signal and the threshold voltage of the drive circuit into the second node N2; and charging the energy storage circuit by the first node and the second node to write the data signal and the threshold voltage of the drive circuit into the energy storage circuit.

19. The pixel driving method according to claim 17, wherein a buffer period exists between an enable period of the reset signal and an enable period of the scan signal.

* * * * *